US005676121A

United States Patent [19]

Bizier

[11] Patent Number: 5,676,121

[45] Date of Patent: Oct. 14, 1997

[54] FORK TAMER

[76] Inventor: Wayne T. Bizier, P.O. Box 3142, Bristol, Conn. 06011

[21] Appl. No.: 689,482

[22] Filed: Aug. 8, 1996

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 3,769,956 | 11/1973 | Simo | 124/44.5 |
| 4,809,670 | 3/1989 | Simo | 124/44.5 |
| 5,070,855 | 12/1991 | Troncoso | 124/44.5 |
| 5,181,502 | 1/1993 | Ray | 124/44.5 |
| 5,341,789 | 8/1994 | Paglia | 124/44.5 |
| 5,353,778 | 10/1994 | Blankenship | 124/44.5 |
| 5,385,135 | 1/1995 | Saunders | 124/44.5 |
| 5,429,107 | 7/1995 | Troncoso | 124/44.5 |
| 5,460,152 | 10/1995 | Specht | 124/44.5 |
| 5,577,489 | 11/1996 | Troncoso | 124/44.5 |

*Primary Examiner*—John A. Ricci

[57] ABSTRACT

A fork tamer including a forked arrow rest. The forked arrow rest has a pair of prongs with end portions for supporting an arrow. Included are a pair of generally cylindrical members. Each cylindrical member has a first end, a second end and a cylindrical bore. The first end of each cylindrical member is enclosed. The second end of each cylindrical member is open and allows for placement of each cylindrical member over one of the pair of prongs of the forked arrow rest.

1 Claim, 2 Drawing Sheets

FIG. 1
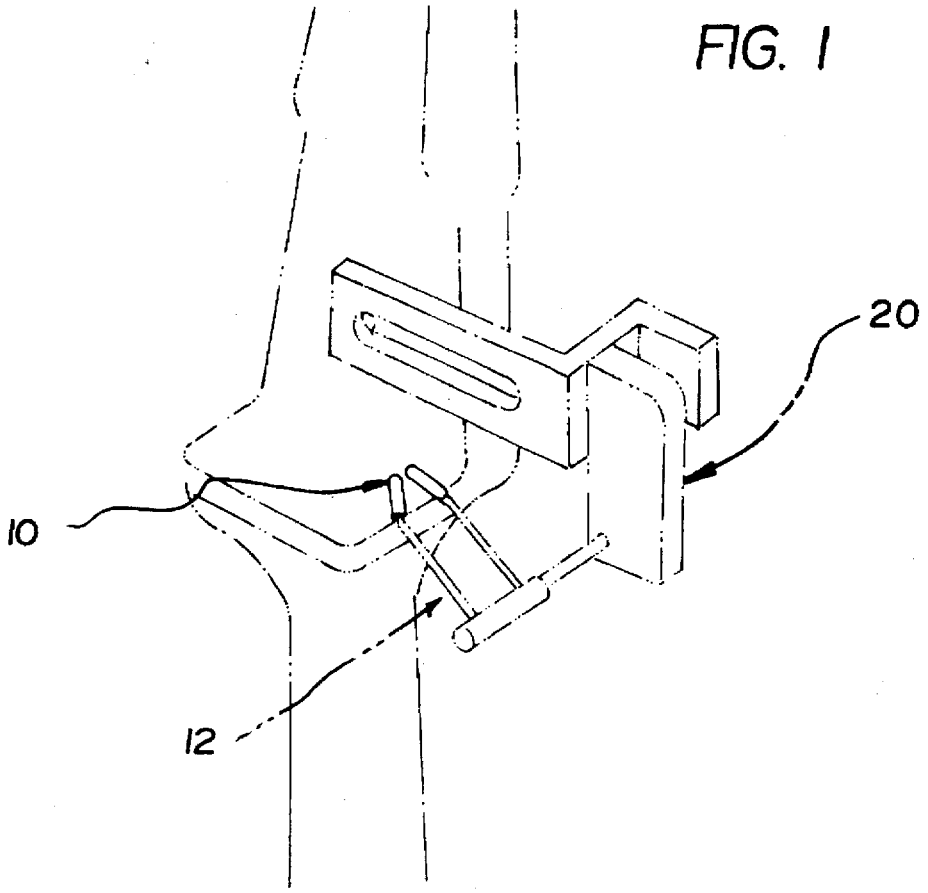
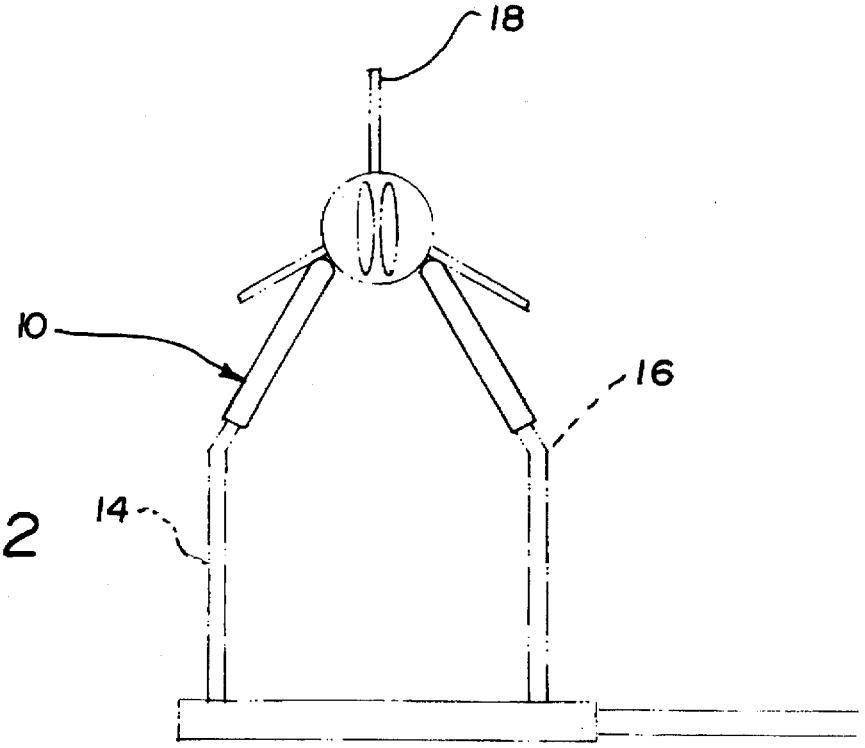
FIG. 2

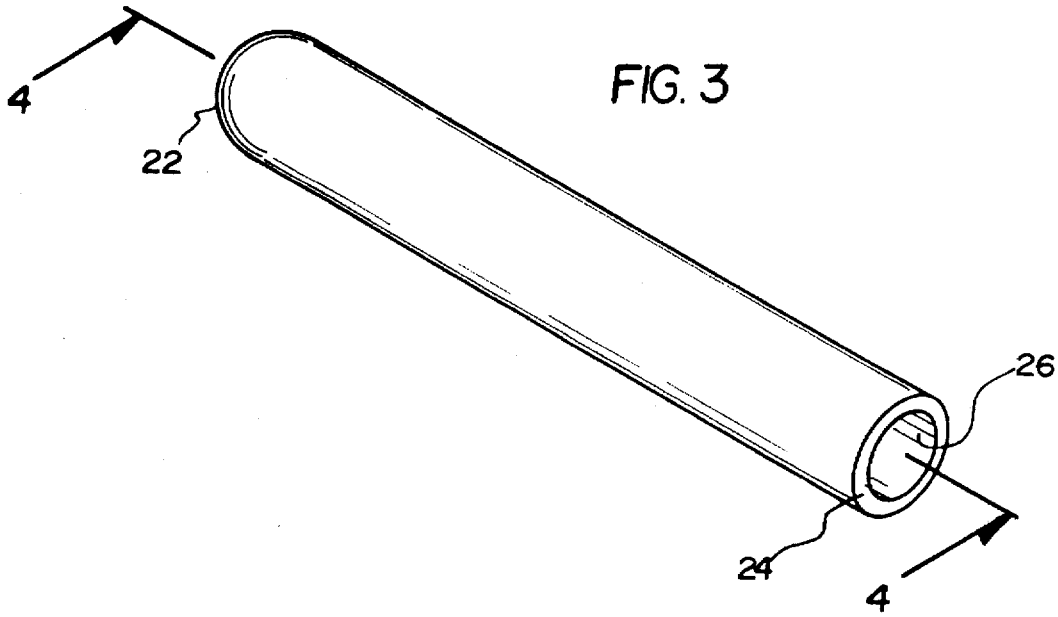
FIG. 3
FIG. 4
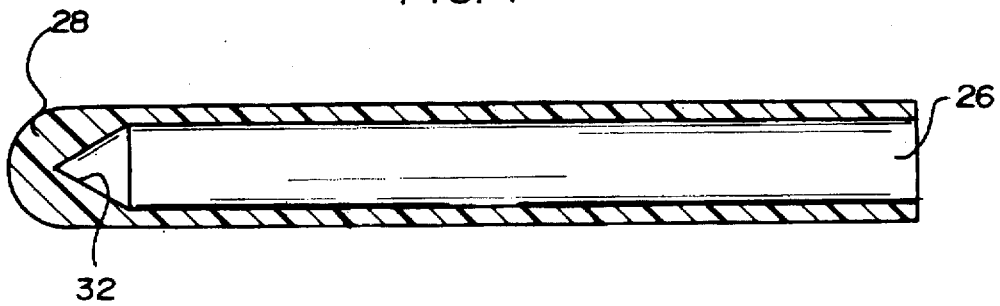

FORK TAMER

BACKGROUND OF THE INVENTION

1. Field of the Invention

The present invention relates to a fork tamer and more particularly pertains to providing an archery accessory that is slipped over the prongs of a forked arrow rest.

2. Description of the Prior Art

The use of sheaths is known in the prior art. More specifically, Sheaths heretofore devised and utilized for the purpose of noise reduction when using forked arrow rest are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,400,763 to Mazza discloses an arrow rest for archery bows. U.S. Pat. No. 5,383,441 to Lightcap discloses an adjustable arrow rest assembly. U.S. Pat. No. Des 342,118 to Mann discloses a arrow rest for an archery bow. U.S. Pat. No. 5,2144,937 to Colvin discloses an archery bow arrow rest. U.S. Pat. No. Des. 266,179 to Peck discloses an arrow rest for an archery bow Lastly, U.S. Pat. No. Des. 314,602 to Grover discloses an arrow rest.

While these devices fulfill their respective, particular objectives and requirements, the aforementioned patents do not describe fork tamer that allows noise reduction when the arrow is positioned between the prongs of forked arrow rest and provide no drag to the flight of the arrow that is supported.

In this respect, the fork tamer according to the present invention substantially departs from the conventional concepts and designs of the prior art, and in doing so provides an apparatus primarily developed for the purpose of providing an archery accessory that is slipped over the prongs of a forked arrow rest.

Therefore, it can be appreciated that there exists a continuing need for a new and improved fork tamer which can be used for providing an archery accessory that is slipped over the prongs of a forked arrow rest. In this regard, the present invention substantially fulfills this need.

SUMMARY OF THE INVENTION

In view of the foregoing disadvantages inherent in the known types of Sheaths now present in the prior art, the present invention provides an improved fork tamer. As such, the general purpose of the present invention, which will be described subsequently in greater detail, is to provide a new and improved fork tamer and method which has all the advantages of the prior art and none of the disadvantages.

To attain this, the present invention essentially comprises a forked arrow rest with a pair of prongs that have end portions to supporting an arrow. Included are a pair of generally cylindrical members. Each cylindrical member has a first end, a second end and a cylindrical bore. Each cylindrical member having a length of about 1.25 inches and an outer diameter of about 0.188 inches. The cylindrical bore of each cylindrical member has a diameter of about 0.125 inches. The first end of each cylindrical member is enclosed with a bulbous thickening. The cylindrical bore of each cylindrical member has an end tip that is conical. Each end tip is adjacent the bulbous of the first end. The second end of each cylindrical member is open to allow placement of each cylindrical member over one of the pair of prongs of the forked arrow rest. The pair of cylindrical members are capable of engaging the arrow that is positioned within the forked arrow rest.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fork tamer which has all of the advantages of the prior art sheaths and none of the disadvantages.

It is another object of the present invention to provide a new and improved fork tamer which may be easily and efficiently manufactured and marketed.

It is further object of the present invention to provide a new and improved fork tamer which is of durable and reliable constructions.

An even further object of the present invention is to provide a new and improved fork tamer which is susceptible of a low cost of manufacture with regard to both materials and labor, and which accordingly is then susceptible of low prices of sale to the consuming public, thereby making such Fork tamer economically available to the buying public.

Even still another object of the present invention is to provide a fork tamer for providing an archery accessory that is slipped over the prongs of a forked arrow rest.

Lastly, it is an object of the present invention to provide a new and improved fork tamer including a forked arrow rest. The forked arrow rest has a pair of prongs with end portions for supporting an arrow. Included are a pair of generally cylindrical members. Each cylindrical member has a first end, a second end and a cylindrical bore. The first end of each cylindrical member is enclosed. The second end of each cylindrical member is open and allows for placement of each cylindrical member over one of the pair of prongs of the forked arrow rest.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the fork tamer constructed in accordance with the principles of the present invention.

FIG. 2 is top plan view of the fork tamer in an operable orientation.

FIG. 3 is an isometric view of the cylindrical member of the fork tamer.

FIG. 4 is a cross-sectional view of the cylindrical member of the fork tamer.

The same reference numerals refer to the same parts through the various Figures.

DESCRIPTION OF THE PREFERRED EMBODIMENT

With reference now to the drawings, and in particular to FIG. 1 thereof, the preferred embodiment of the new and improved fork tamer embodying the principles and concepts of the present invention and generally designated by the reference numeral 10 will be described.

The present invention, the fork tamer 10 is comprised of a plurality of components. Such components in their broadest context include a forked arrow rest and a pair of cylindrical members. Such components are individually configured and correlated with respect to each other so as to attain the desired objective.

Specifically, the present invention includes a forked arrow rest 12 as seen in FIG. 1. The forked arrow rest has a pair of prongs 14 and each has end portions 16 for supporting an arrow 18. The prongs of the forked arrow rest are stainless steel The forked arrow rest is easily coupled with an adjustable arrow rest assembly 20 that is attached to a bow.

Included are a pair of generally cylindrical members 10. Each cylindrical member, as seen in FIG. 3, has a first end 22, a second end 24 and a cylindrical bore 26. Each cylindrical member is made from a self lubricating plastic. One such plastic that is used in fabricating the cylindrical member is TEFLON. Each cylindrical member has a length of about 1.25 inches and an outer diameter of about 0.188 inches. The cylindrical bore of each cylindrical member has a diameter of about 0.125 inches.

Also, the first end of each cylindrical member is enclosed with a bulbous thickening 28, as seen in FIG. 4. The cylindrical bore of each cylindrical member has an end tip 32 that is conical and adjacent the bulbous of the first end. The second end of each cylindrical member is open for allowing placement of each cylindrical member over one of the pair of prongs 14 of the forked arrow rest. Each cylindrical member 10 slides easily over one of the prongs for placement and removal. Each cylindrical member, when positioned on the prong will engage the arrow being positioned within the forked arrow rest. Each cylindrical member, may be replaced with another cylindrical member as it wears down.

The present invention fork tamer is an archery accessory that will improve the qualities of shoot-thru rest. Currently archers cover the end of the prongs of the forked arrow rest with shrink-tubing. Shrink tubing is used because the forked arrow rest as currently structured is noisy. Shrink tubing eliminates some noise but produces a drag on the arrow. Drag in the arrow will slow the flight of the arrow. The present invention fork tamer reduces the noise and has no drag effect on the arrow. The cylindrical members of the present invention provide more clearance for the vane of the arrow when positioned between the forked arrow rest. The additional clearance for the vane of the arrow allows the arrow to fly more consistently.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved fork tamer for use with a forked arrow rest with a pair of prongs having end portions for supporting an arrow therebetween comprising:

a pair of generally cylindrical members with each having a first end, a second end and a cylindrical bore therebetween, each cylindrical member having a length of about 1.25 inches and an outer diameter of about 0.188 inches, the cylindrical bore of each cylindrical member having a diameter of about 0.125 inches, the first end of each cylindrical member being enclosed with a bulbous thickening, the cylindrical bore of each cylindrical member having an end tip being conical and adjacent the bulbous thickening of the first end, the second end of each cylindrical member being open for allowing placement of each cylindrical member over one of the pair of prongs of the forked arrow rest, the pair of cylindrical members capable of engaging the arrow being positioned within the forked arrow rest.

* * * * *